United States Patent [19]

Dodsworth et al.

[11] 3,978,232

[45] Aug. 31, 1976

[54] THIN WALLED CONTAINERS FOR PRESSURIZED LIQUIDS

[76] Inventors: Edward Dodsworth, 6 Willow Close, Gomersal, Yorkshire; Thomas Norman Gaunt, 179 Wetherby Road, Leeds 17, Yorkshire; Wynn Price Davies, "Dormers", 19 Holmdene Ave., Mill Hill, London N.W.7; David Reed Wilkins, 7 Garnett Drive, Brickett Wood, near St. Albans, Hertfordshire, all of England

[22] Filed: June 19, 1974

[21] Appl. No.: 480,916

Related U.S. Application Data

[63] Continuation-in-part of Ser. No. 212,491, Dec. 27, 1971, abandoned.

[30] Foreign Application Priority Data

Dec. 30, 1970 United Kingdom ..... 61817/70

[52] U.S. Cl. ..... 426/115; 215/1 C; 229/1.5 B; 229/14 B; 426/106; 426/118

[51] Int. Cl.[2] ..... B65D 23/00; B65D 3/00; B65B 31/02

[58] Field of Search ..... 426/86, 106, 110, 111, 426/115, 118, 411; 215/1 C; 229/14 B, 1.5 B

[56] References Cited

UNITED STATES PATENTS

| | | | |
|---|---|---|---|
| 3,325,030 | 6/1967 | Rausing et al. | 215/12 |
| 3,339,605 | 9/1967 | Ignell | 215/1 C |
| 3,355,080 | 11/1967 | Rausing et al. | 229/14 B |
| 3,426,102 | 2/1969 | Solak et al. | 215/1 C |
| 3,480,168 | 11/1969 | Lee | 215/1 C |
| 3,485,412 | 12/1969 | Hawley | 229/1.5 B |
| 3,487,989 | 1/1970 | Rausing et al. | 229/14 B |
| 3,529,647 | 9/1970 | Ignell | 150/.5 |
| 3,662,944 | 5/1972 | Joosten, Sr. | 229/14 B |
| 3,666,163 | 5/1972 | Ignell | 229/14 B |
| 3,671,607 | 6/1972 | Lee | 215/1 C |
| 3,717,274 | 2/1973 | Wingaran | 215/1 C |

FOREIGN PATENTS OR APPLICATIONS

| | | | |
|---|---|---|---|
| 323,301 | 4/1970 | Sweden | 229/14 B |

*Primary Examiner*—Steven L. Weinstein
*Attorney, Agent, or Firm*—Fred Philpitt

[57] ABSTRACT

A carbonated beverage package comprising an inner container gas tight sealed by means of a lid and containing carbonated beverage, and an outer restraining cup in which the inner container locates and which restrains the inner container from excessive expansion due to the pressure of the beverage in the inner container, but which can readily be detached from the inner container for use as a drinking vessel upon release of the pressure within the container: the materials intended for the inner container and outer cup have particular characteristics and thicknesses to achieve the desired results.

1 Claim, 7 Drawing Figures

THIN WALLED CONTAINERS FOR PRESSURIZED LIQUIDS

This is a continuation-in-part of our application Ser. No. 212,491, filed Dec. 27, 1971, now abandoned.

FIELD OF THE INVENTION

The present invention relates to sealed thin walled containers which are filled with carbonated beverage. The internal pressure in such containers, as a result of a change in the environment surrounding the containers, can increase due to the liberation of gas from the beverage. Examples of such carbonated beverages are beer and some soft drinks. In particular, the invention concerns a package of which such a thin walled container is a part.

DISCUSSION OF THE PRIOR ART

There have been many proposals for the packaging of carbonated beverage in sealed thin wall containers of plastics materials. These proposals, it must be stated, have been to a large extent paper proposals insofar as few containers of plastics materials and containing carbonated beverages are available to the general public. This, it is felt strongly by the inventors of this invention, is due to the fact that special problems, which are not fully understood, exist in connection with the packaging of carbonated beverage in plastics material containers. The main problem is that, generally speaking, plastics materials which are suitable for these thin walled containers from a characteristic and price point of view, are to a greater or lesser extent expansible, and after such a container is charged with a quantity of carbonated beverage and sealed, the pressure inside the container increases and the container expands, or tends to expand putting the plastics material of the container under stress. If the plastics material has not been carefully selected, the container will burst under the internal pressure, or if it does not burst, it may distort, and if it neither distorts or bursts, it is likely to be too thick, making it prohibitively expensive.

It is clear from the proposals which have been put forward to date, that other inventors working in this field have been grappling with similar problems, because they have proposed arrangements for inhibiting expansion of the container wall. In one proposal, a cardboard sleeve is applied to the outside of the container to restrain expansion. The disadvantage of this arrangement is that it is a package of two different materials, namely plastics and cardboard, and therefore is inconvenient to produce, and furthermore the sleeve can serve no other purpose than reinforcement.

It has also been proposed to provide a package comprising an inner container of plastics material in which the carbonated beverage is held and an outer cup in which the inner container is held. The outer cup serves to strengthen the inner container wall against due to the internal pressure of the carbonated beverage, and also can be used as a drinking vessel for the beverage when the inner container has been opened for drinking of the beverage. In designing this prior package, the inventor obviously was concerned with the problem of dealing with the increase in pressure in the inner container, because the inner container is provided with a concave base which is designed to "pop-out" after filling with the beverage and sealing of the inner container. This package is not available to the public, and the inventors of the present invention believe that this is because the prior arrangement has not been developed to a sufficient extent to enable the popping-out of the base to be predicted reliably in relation to the internal pressure in the container.

The inventors of the present invention have also been working on a two part package involving an inner container and an outer cup, both of plastics material, and have realised that special materials of a particular thickness must be selected in order to achieve a package which behaves predictably in relation to the internal pressure, has good handlability, and is commerically acceptable.

TECHNICAL BACKGROUND

The present invention is concerned with the use of high impact polystyrene for the inner container and outer cup. High impact polystyrene is styrene which is reinforced during the polymerisation process by the addition of synthetic rubber such as polybutadiene or butadiene styrene rubber. Depending upon the rubber content, the resulting high impact polystyrene can be rigid in nature (low rubber content) or elastic in nature (high rubber content). The elastic limit of a high impact polystyrene therefore varies in accordance with the rubber content. A commonly used method for indicating the impact resistance and elasticity is the Izod. Impact measurement, and the characteristics of the high impact polystyrenes used in the present invention are expressed in terms of the Izod Impact Measurement.

DEVELOPMENT OF THE INVENTION

Tests using high impact polystyrene of high rubber content for the inner containers of the package revealed that the inner container expanded prohibitively when filled with carbonated beverage and sealed. Low rubber content polystyrene was satisfactory for the inner container, except that such material is excessively brittle for normal handling purposes.

It was decided therefore that the outer cup should be constructed from high rubber content polystyrene whilst the inner container could be formed from a high rubber content polystyrene. The inner container would thus provide the rigidity, and the outer cup the resistance to normal handling such as transportation.

Selection of material did not finalize the solution, because the inventors were also concerned that the outer cup and inner container should be held frictionally together under the action of the internal pressure of the inner container, and yet the outer cup should be usable as a drinking vessel when the pressure of the inner container is relieved.

BRIEF SUMMARY OF THE INVENTION

Basically, the effects of the invention are achieved in a package comprising an inner, thin walled container of high impact polystyrene of Izod Impact Measurement in the range 1.0 to 1.25 ft-lb./in. of notch and a wall thickness in the range 0.013 to 0.018 inch, a quantity of carbonated beverage in the inner container maintaining a pressure of at least 30 p.s.i inside the inner container means sealing the inner container, release means forming part of the means sealing the inner container, said release means being manually operable whereby the pressure of the carbonated beverage inside the container may be released and access to the beverage obtained, and an outer restraining cup of high impact polystyrene of Izod Impact Measurement in the range 1.7 to 2.1 ft-lb./in. of notch and a wall thickness which is greater than that of the inner container, said restraining cup engaging at least an annular wall region of the container.

By using the high impact polystyrenes mentioned above, it is ensured that the internal pressure of over 60 p.s.i. extend the thin wall of the inner container outwardly into firm frictional engagement with the outer cup and the cup and inner container cannot be separated manually. When the release means is opened however, the inner container as it is not stretched beyond its elastic limit contracts enabling the outer cup to be removed for use as a drinking vessel.

The inner container may be of inverted frusto conical form with a seating ring at the top and a hemi or part spherical base and the cup would preferably have a wall of similar frusto conical shape. The top of the cup may have a rim on which the seating ring can seat and a generally flat base whereby the cup and the inner container can be free standing. By this construction, the cup can be used to support the container whilst it is being filled and sealed.

The container preferably has a gas impermeable liner and is manufactured along with other containers by being vacuum or otherwise formed in a laminate made up of plastics case material and a sheet of liner material, and then being removed, as by cutting from such laminate.

In the filling of inner containers with carbonated beverage, the beverage is usually chilled when it is charged into the inner containers and being so it is important that the containers should be sealed as soon as possible after filling in order to maintain as much carbon dioxide in solution in the beverage as possible, because the loss of carbon dioxide from the beverage causes it to become "flat" and unpleasant to drink. After sealing, the pressure in the inner container will rise due to the temperature of the environment in which the inner containers are filled and sealed unless, of course, the containers are filled in a refrigerated room which would be impractical.

BRIEF DECRIPTION OF THE DRAWINGS

Figure 1:
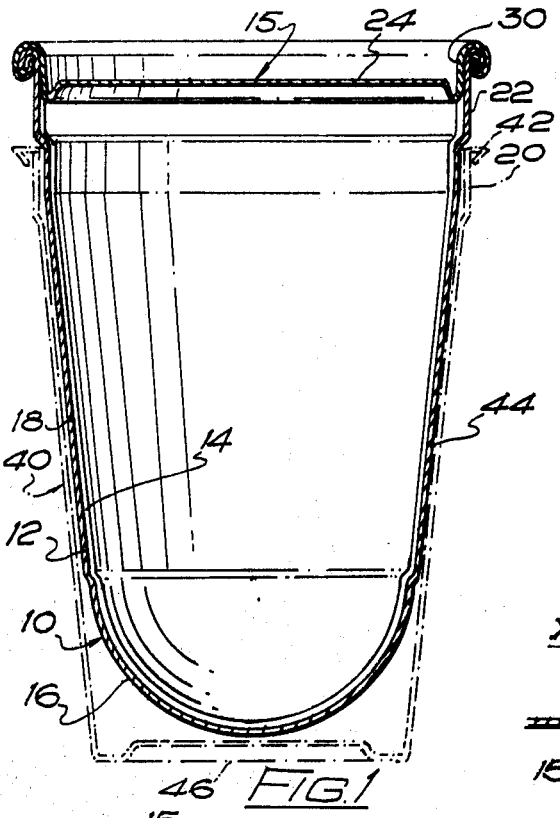
FIG. 1 is a cross sectional elevation of a package according to the invention.

Referring to the drawings, and firstly to FIG. 1, the inner container is indicated generally by the numeral 10 and will be seen to comprise an outer case 12 which is of high impact polystyrene of Izod Impact Measurement in the range 1.0 to 1.25 ft-lb./in. of notch and of a thickness in the range 0.016 to 0,018 inch, an inner liner 14 of a synthetic plastics material which is highly impermeable to gas under pressure such as BAREX 210, an acrylonitrile copolymer, (again other materials could be used) and a metal lid 15 which seals the inner container.

The outer case 12 and inner liner 14 may be vacuum formed simultaneously in a laminate of high impact polystyrene and BAREX 210, although it is possible to form the case and liner separately or form the liner by spraying inside of the case with a liquid which sets form the liner.

The liner 14 may be a bag or sac which takes up the shape of the inner surface of the case 12 upon being filled.

The outer case and liner when vacuum formed together, as in the example illustrated, have the same shape which is circular in transverse cross section and is made up of a hemi or part spherical base 16, a frusto conical wall section 18, a cylindrical section 20 for engaging a restraining cup and a de-nesting ring 22. The ring 22 has at its top end an outwardly extending flange prior to the seaaling of the container by means of the lid 15. The frusto conical wall section may be formed with axially or circumferentially extending grooves over part or all of the wall section as desired to give added strength and/or increased expansion capability.

The lid 15 may be, for example, of aluminium and may be of the ring pull type i.e. it may be provided in the recessed base 24 with a readily removable section which is attached to a ring for engagement by the finger and by which means the section may be removed to open the container. Alternatively, the lid may be of plastics material of equivalent strength to the aluminium lid and capable of being sealed to the container in the manner of applying the metal lide as described hereinafter.

Where a plastics material lid is used it may in itself be highly gas impermeable, but if not it is preferably coated with a material which renders the lid highly impermeable Where a metal lid is used, this preferably has a protective coating such as a lacquer or resin to protect the lid from the contents of the container, if the metal of the lid is such as would be corroded by the container contents.

Figure 2:
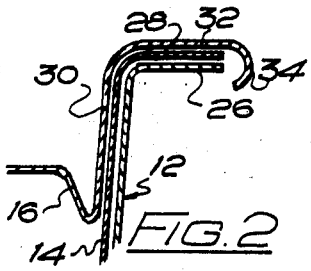
FIGS. 2, 3 and 4 are detailed sectional elevations showing how the container lid is sealed to the inner container liner.
Figure 3:
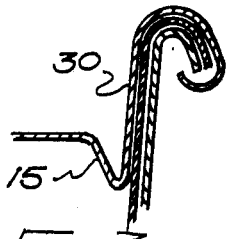
Figure 4:
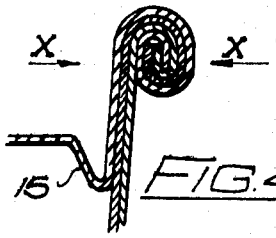

Reference is now made to FIGS. 2, 3 and 4 for an explanation of the manner in which the lid seals the container. Before sealing the open top, case 12 has an outwardly extending flange 26 and the liner 14 has a similar outwardly extending flange 28 which overlies flange 26. The lid 15 has an upwardly extending wall 30 from which extends an outwardly extending flange 32. At its outer edge flange 32 has a downwardly and inwardly turned lip 34. The lid 15 is of such dimensions that when the lid 15 is dropped over flanges 24, 22, the lip 24 takes up the position shown in FIG. 2.

The flanges 32, 28 and 26 are now turned inwardly as shown in FIG. 3, but by a suitable forming tool by rotating the container with its lid about its axis and relative to the tool, until the flanges 26, 28 and 32 are, in section, spiralled one within the other, forming the seal between the lid 15 and case 12. It is to be noted that in actual fact the lid 15 contacts the liner 14 and the seal is between liner 14 and lid 15.

If desired, to complete the seal, the spiral comprising flanges 32, 28 and 26 may be compressed radially of the container as indicated by arrows X—X in FIG. 4.

It will be noted that there is no sealing gasket or compound on the underside of flange 32 of lid 15, which is the normal practice in the sealing of metal lids to metal containers. It is of advantage in this invention to omit this gasket or compound because thereby the flange 32 and lip 34 can be wrapped further round in relation to the flanges 26, 28 than would be the case if a gasket or compound were present. In some cases however, a sealing compound may be used or in some other cases a plastic, deformable gasket may be used. This could be of a thermo-plastic or thermo-setting nature which could be softened by heat to effect the seal after the wrapping round of flanges 24, 26 and 32.

The container is filled prior to the sealing thereof by the lid 15.

In the filling of containers with carbonated beverage, the beverage may be maintained at a temperature below ambient or at ambient temperature. In either case, it is desirable to seal the container as soon as possible after filling in order that the carbonation or carbon dioxide in the beverage, will not be lost. The result is that after container filling and sealing there is an increase in pressure within the container and the case wall 18 and base 16 are subjected to this increase in pressure. The base 16 being hemi or part spherical is structurally strong and does not deform but the wall tends to expand. This is restrained by the specific form of high impact polystyrene selected for the outer case and by placing the container, within two minutes of the filling and lidding, in a restraining cup indicated by numeral 40 in FIG. 1 which may be of the same general configuration as the container i.e. it has a top rim 42 on which nesting ring 22 seats, a frusto conical wall 44 of the same taper as wall 18 and a generally flat base 46 on which the cup in supporting the container can stand. The cup 40 is also of high impact polystyrene but has an Izod Impact Measurement in the range 1.7 to 2.1 ft-lb./in. of notch and a wall thickness in the range 0.018 to 0.020 inch to give the package good handlability.

Assume that the container has only just been filled with carbonated beverage and sealed. The beverage will normally be chilled when it is charged into the container, but with increase in the beverage temperature the pressure in the contailer will increase to at least 60 p.s.i. and expand the wall 18 causing it to come into firm contact with wall 44 and the cup 40 can serve as a stand for the container even whilst it is being filled and sealed because clearly the container 10 having a part spherical bottom would not stand upright without additional support. However, by suitable holding tools, the part spherical based container can be handled for filling and sealing without the use of the restraining cup.

In the case of the restraining cup 40 as shown the cup 40 and outer case 12 are constructed so that there is a light frictional engagement therebetween before the wall 18 expands as a result of increase in internal pressure within the container. This is achieved by the cylindrical section 20 of case 12 which engages neatly the inner surface of the ring 42 of outer cup 40.

Figure 5:
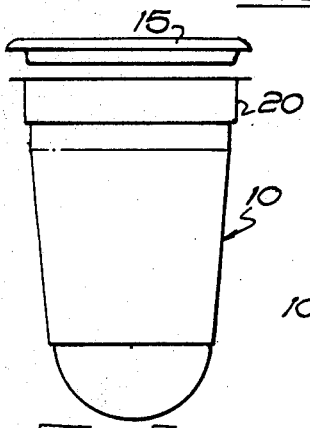
FIGS. 5, 6 and 7 illustrate diagrammatically the steps of sealing the inner container and bringing together of the inner container and the restraining cup.
Figure 7:
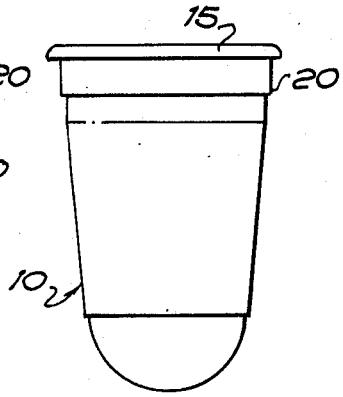
Figure 7:
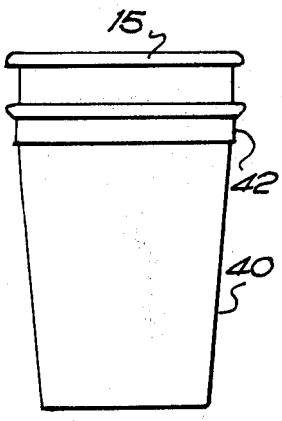
Figure 6:
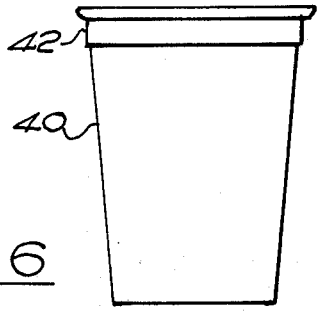

Finally, FIGS. 5, 6 and 7 illustrate diagrammatically the steps involved in producing the final package, FIG. 7, comprising container and restraining cup. In FIG. 5 the container 10 has been filled with carbonated beverage and is about to have the lid 15 applied thereto. FIG. 6 shows the container 10 after having been sealed by lid 15 and about to be placed in cup 40. The initial engagement between cup 40 and container 10 is the light frictional engagement referred to previously as between ring 20 and rim 42, but the friction engagement increases when the wall 18 expands as a result of increase in pressure within container 10, also as explained previously.

In an alternative arrangement, the liner 14 may be omitted, provided that the case 12 is of a material which is highly gas impermeable. Moreover, it is not essential that the package should have the general circular section as shown, although this shape is preferred.

The utilization of particular Izod Measurement for the inner container and outer cup provides a package which is practically useful, is of a cost competitive with equivalent metal cams, has the required handlability, and is stable under the normal pressures experienced in container holding carbonated beverages.

We claim:

1. A package containing carbonated beverage comprising in combination:

a. an inner container
   1. having a closed bottom and open top and side walls extending therebetween,
   2. having thin walls,
   3. composed of high impact polystyrene of Izod Impact Measurement within the range of 1.0 to 1.25 ft.-lb./in. of notch, and
   4. having a wall thickness within the range of 0.013 – 0.018 inches, b. a lid member extending across the open top of said inner container and including release means forming part of the lid member which is manually operable to release the pressure inside the container, c. sealing means adjacent the periphery of said lid member and adjacent the periphery of the open top of said inner container for engaging said lid member in a sealing relationship across the open top of said inner container, d. a quantity of carbonated beverage located within the inner container closed by said lid member and which maintains a pressure of at least 30 p.s.i. once said lid member has been applied across the open top of said inner container, and e. a restraining cup disposed annularly around said inner container and engaging at least a portion of the walls of said inner container, said restraining cup
   1. being composed of high impact polystyrene of Izod Impact Measurement in the range of 1.7 to 2.1 ft-lb/in. of notch, and
   2. having a wall thickness which is greater than that of the inner container, whereby the increase in pressure within the container, due to the temperature of the environment, will extend the walls of the inner container outwardly into firm frictional engagement with the restraining cup such that the cup and inner container cannot be separated manually until the release means is opened and the pressure relieved.

* * * * *